US007380472B2

(12) United States Patent
Hsieh

(10) Patent No.: US 7,380,472 B2
(45) Date of Patent: Jun. 3, 2008

(54) HAND TOOL WITH TORQUE MEASURING DEVICE

(76) Inventor: Chih-Ching Hsieh, 5F-2, No. 181, Sec. 2, Mei Tsun Rd., Taichung City (TW)

( * ) Notice: Subject to any disclaimer, the term of this patent is extended or adjusted under 35 U.S.C. 154(b) by 111 days.

(21) Appl. No.: 11/448,082

(22) Filed: Jun. 7, 2006

(65) Prior Publication Data

US 2007/0295107 A1 Dec. 27, 2007

(51) Int. Cl.
*B25B 23/14* (2006.01)

(52) U.S. Cl. ..... 73/862.21; 73/862.22; 73/862.23; 73/862.24; 73/862.26

(58) Field of Classification Search ..... 73/862.21–862.24, 862.26
See application file for complete search history.

(56) References Cited

U.S. PATENT DOCUMENTS 4,006,629 A * 2/1977 Barrett et al. ..... 73/862.26
5,503,028 A * 4/1996 Brihier ..... 73/862.21
6,784,799 B2 * 8/2004 Hsien ..... 340/668
6,928,885 B1 * 8/2005 Shiao et al. ..... 73/862.21
6,940,417 B2 * 9/2005 Hsien ..... 340/668
6,948,380 B1 * 9/2005 Shiao et al. ..... 73/862.21
7,089,807 B2 * 8/2006 Hsieh ..... 73/862.22
7,104,144 B1 * 9/2006 Hsieh ..... 73/862.21
7,194,940 B2 * 3/2007 Hsieh ..... 81/479
7,197,966 B1 * 4/2007 Hsieh ..... 81/177.9
2002/0178873 A1 * 12/2002 Hsieh ..... 81/125.1
2004/0261542 A1 * 12/2004 Hsien ..... 73/862.21
2006/0011023 A1 * 1/2006 Hsieh ..... 81/479
2006/0090575 A1 * 5/2006 Hsieh ..... 73/862.623
2006/0156832 A1 * 7/2006 Hsieh ..... 73/862.21
2006/0201261 A1 * 9/2006 Hsieh ..... 73/862.21

* cited by examiner

*Primary Examiner*—Edward Lefkowitz
*Assistant Examiner*—Freddie Kirkland, III

(57) ABSTRACT

A hand tool includes a handle and a function head is connected to an end of the handle. A first recess and a second recess are respectively defined in two opposite sides of the handle, and a strain transducer is engaged with the first recess. A display member and a processing unit are connected to the handle, and the strain transducer is electrically connected with the processing unit. A hole is defined through the handle and located between the first and second recesses.

3 Claims, 5 Drawing Sheets

HAND TOOL WITH TORQUE MEASURING DEVICE

FIELD OF THE INVENTION

The present invention relates to a hand tool and a strain transducer is connected to a side of the handle, the handle has a through hole which is located close to the strain transducer so that the deformation of the strain is significant to be measured.

BACKGROUND OF THE INVENTION

A conventional hand tool generally does not include a strain transducer which is able to measure and indicate the torque that the workpiece is applied by the hand tool. U.S. Pat. No. 4,006,629 discloses a torque measuring apparatus which includes four strain transducers on two sides of the handle, and a display member is located on the handle so as to display the torque that the four strain transducers measure. A conductive wire extends from the display member and might be pulled unintentionally or be tangled by objects around the hand tool to cut off the circuit. Besides, four strain transducers are so costly that the hand tools are not competitive in the market.

The present invention intends to provide a hand tool that includes a hole defined through the handle and a strain transducer is installed close to the hole. The section with the hole of the handle is deformed so that the strain transducer can easily measure the torque.

SUMMARY OF THE INVENTION

The present invention relates to a hand tool comprises a handle and a function head is connected to an end of the handle. The handle has a first recess and a second recess respectively defined in two opposite sides thereof, and a strain transducer is engaged with the first recess. A display member and a processing unit are connected to the handle. The strain transducer is electrically connected with the processing unit. A hole is defined through the handle and located between the first and second recesses.

The primary object of the present invention is to provide a hand tool which has a hole defined through the handle and located close to the function head. Two recesses are defined in two opposite sides of the handle and a strain transducer is engaged with one of the two recesses. The section of the handle that has the hole is deformed when the hand tool outputs a torque and the strain transducer measures the torque by the deformation of the handle.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENTS

Figure 1:
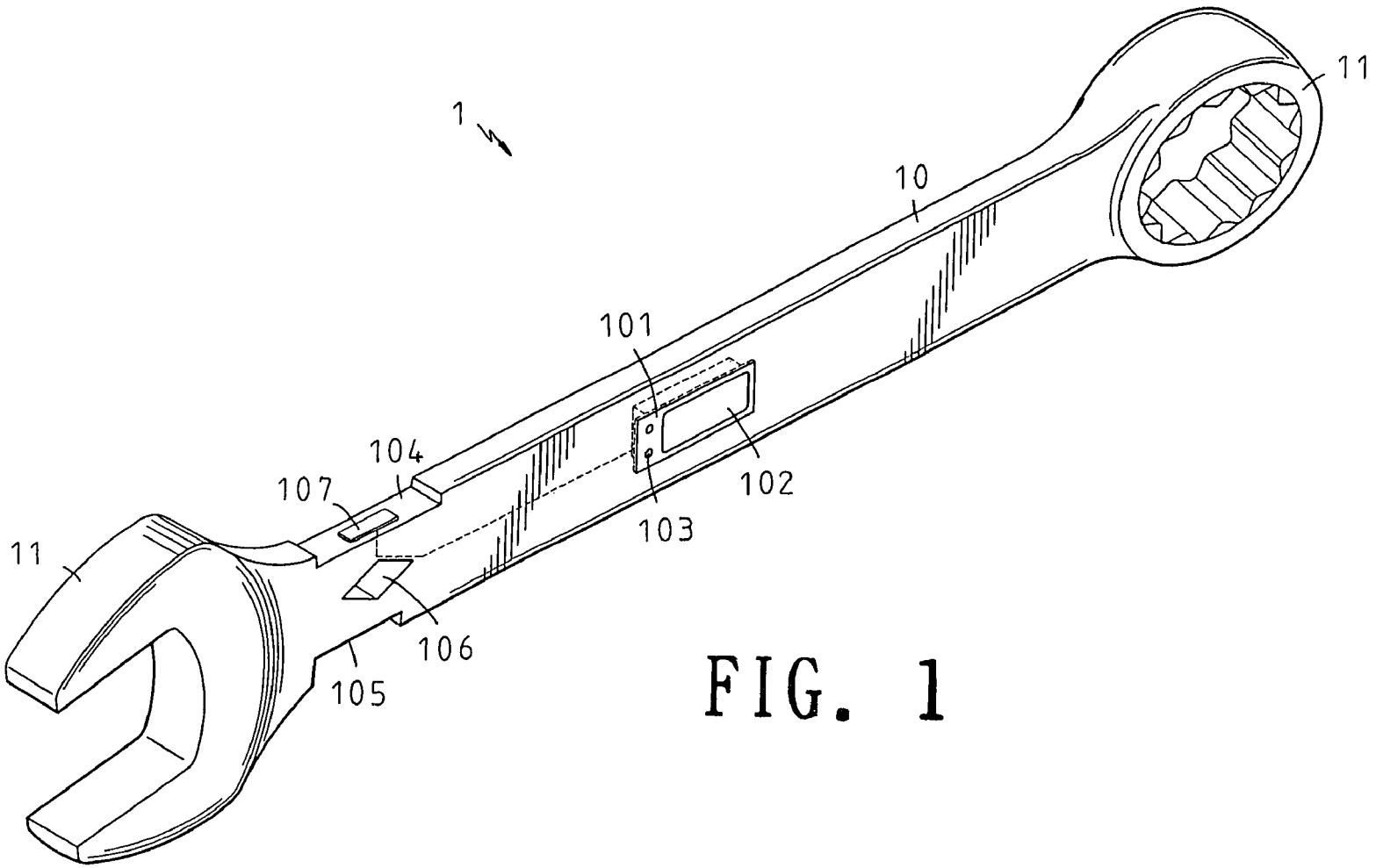
FIG. 1 is a perspective view to show a first embodiment of the hand tool of the present invention.
Figure 2:
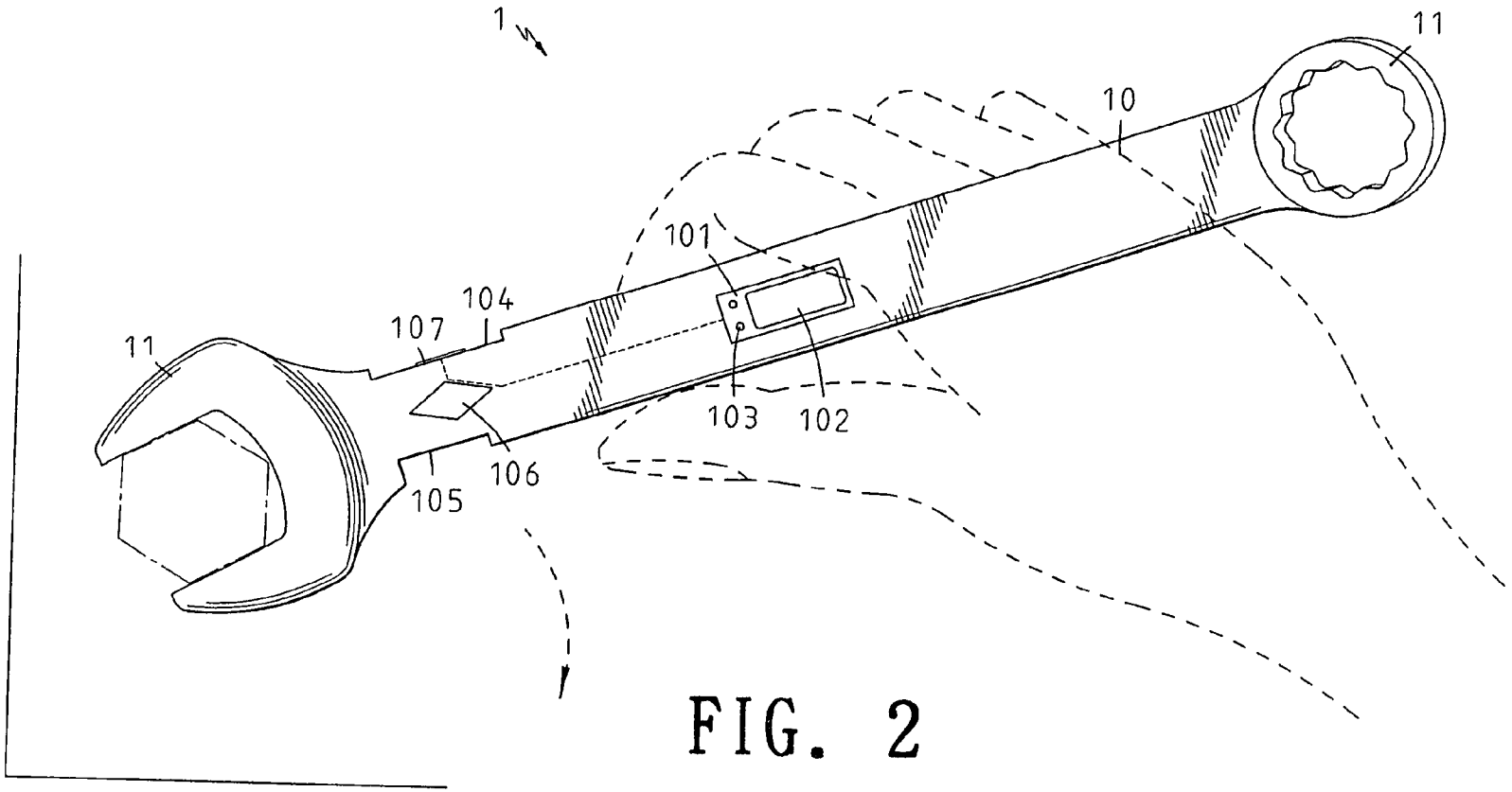
FIG. 2 shows that a user uses the hand tool to rotate a workpiece.

Referring to FIGS. 1 and 2, the first embodiment of the hand tool 1 of the present invention comprises a handle 10 and a function head 11 is connected to an end of the handle 10. A first recess 104 and a second recess 105 are respectively defined in two opposite sides of the handle 10. A length of the first recess 104 is longer than a length of the second recess 105 and the second recess has no strain transducer engaged therewith. A strain transducer 107 is engaged with the first recess 104. A display member 102 is connected to the handle 10 and a processing unit 101 is connected with the display member 102. The display member 102 has at least one operation button 103. The strain transducer 107 is electrically connected with the processing unit 101.

A hole 106 is defined through the handle 10 and located between the first and second recesses 104, 105. The first and second recesses 104, 105 and the hole 106 are located close to the function head 11. An axis of the hole 106 is perpendicular to a direction of rotation of the function head 11. When using the hand tool 1, the function head 11 is mounted onto a workpiece and the user rotates the handle 10 to output a torque to rotate the workpiece. The section of the handle 10 that has the hole 106 is deformed much than the rest portion of the handle 10 and the deformation allows the strain transducer 107 to measure the torque that applied to the workpiece, and the value of the torque is displayed on the display member 102. It is noted that the section having the hole 106 includes less material so that the deformation can be obvious so that the strain transducer 107 is able to measure the torque easily.

Figures 3, 4:
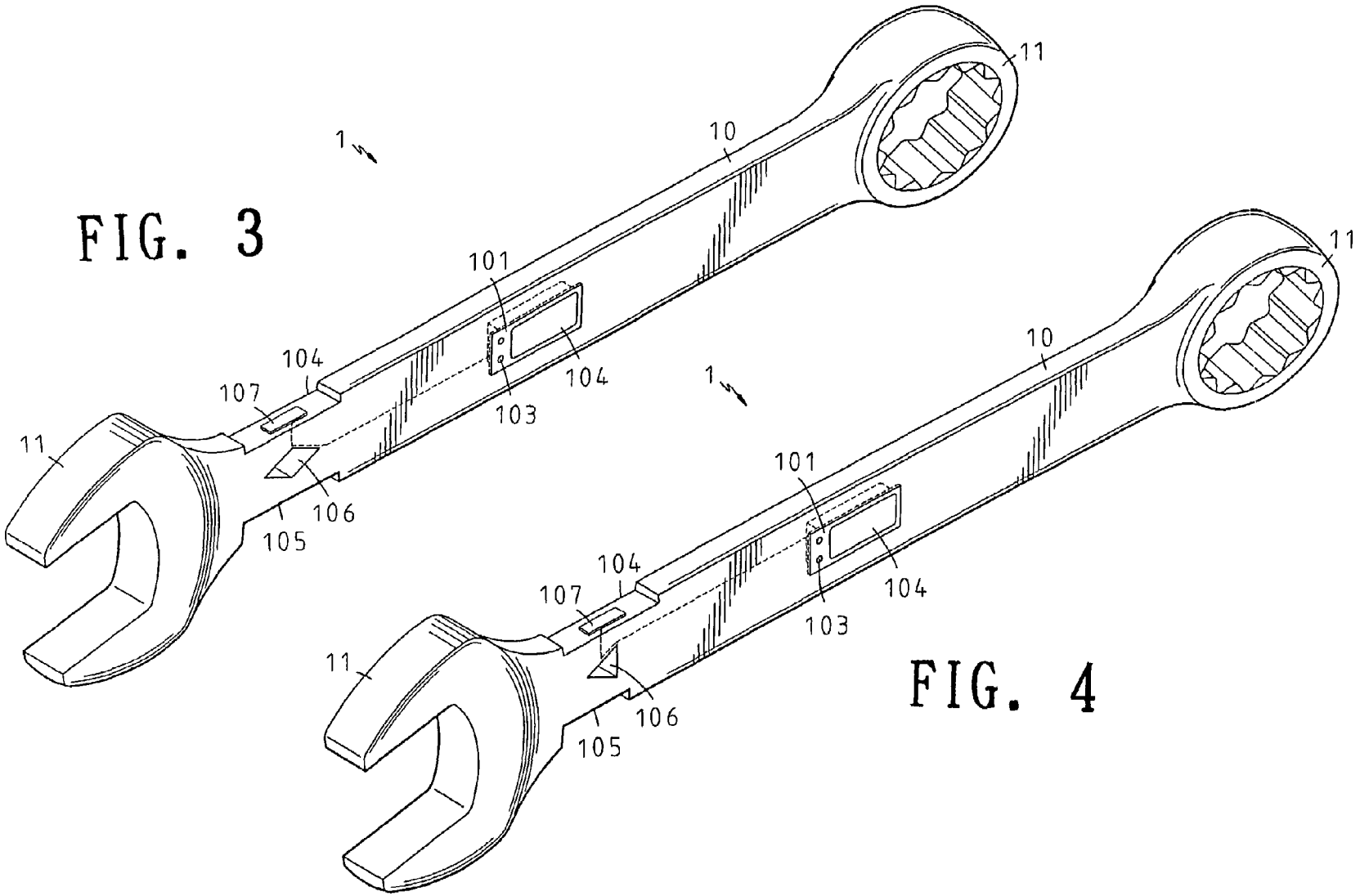
FIG. 3 is a perspective view to show a second embodiment of the hand tool of the present invention.
FIG. 4 is a perspective view to show a third embodiment of the hand tool of the present invention.
Figures 5, 6:
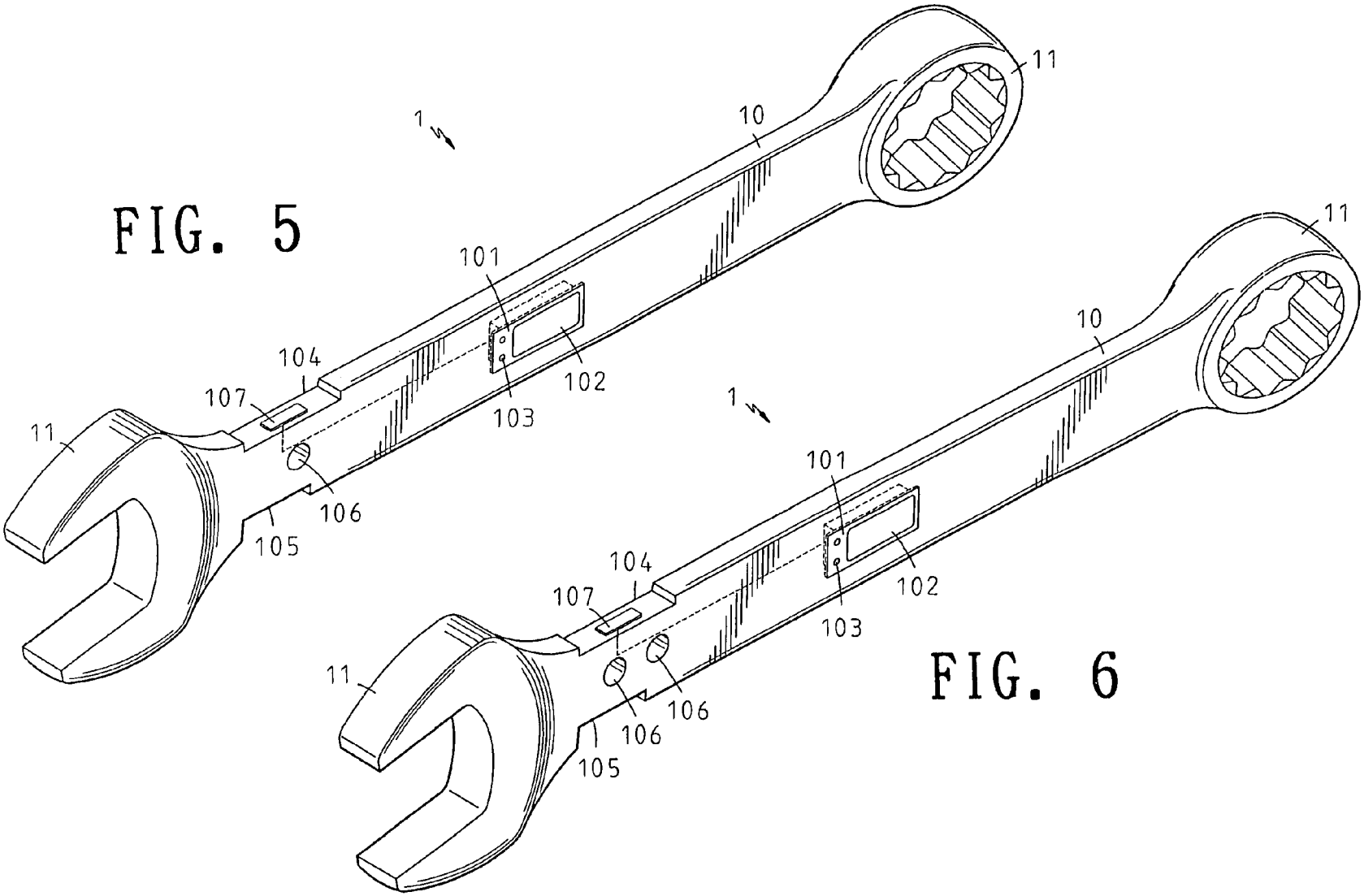
FIG. 5 is a perspective view to show a fourth embodiment of the hand tool of the present invention.
FIG. 6 is a perspective view to show a fifth embodiment of the hand tool of the present invention.
Figure 7:
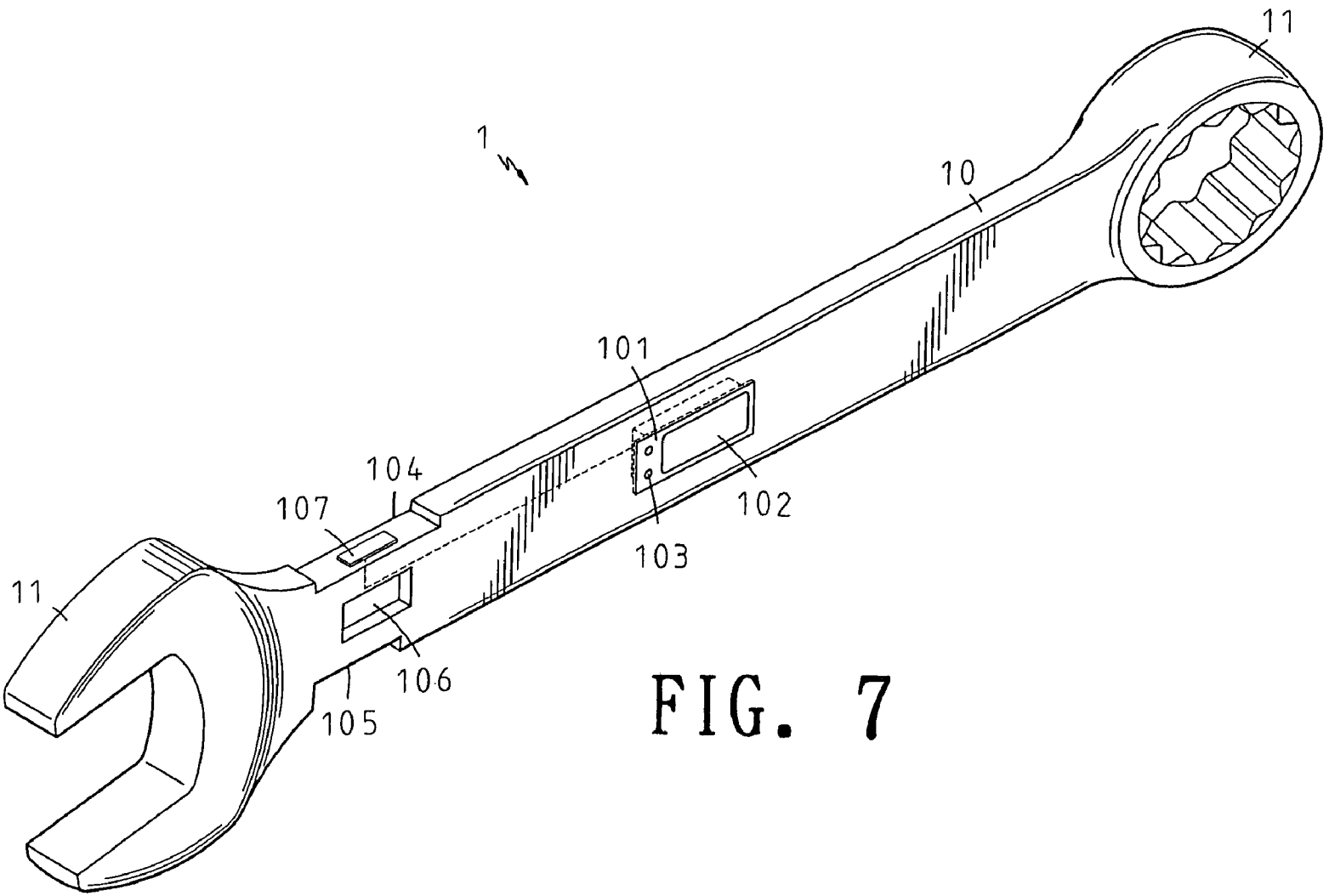
FIG. 7 is a perspective view to show a sixth embodiment of the hand tool of the present invention.

The length of the first recess 104 can be the same as the second recess 105 as disclosed in FIG. 3. FIG. 4 shows that the hole 106 can be a triangular hole. FIG. 5 shows that the hole 106 can be a circular hole, and the number of the hole 106 can be two as shown in FIG. 6. The hole 106 can also be a rectangular hole as shown in FIG. 7.

While we have shown and described the embodiment in accordance with the present invention, it should be clear to those skilled in the art that further embodiments may be made without departing from the scope of the present invention.

What is claimed is:

1. A hand tool comprising:

a handle and a function head connected to an end of the handle;

a first recess and a second recess respectively defined in two opposite sides of the handle, a strain transducer engaged with the first recess and the second recess having no strain transducer engaged therewith, a display member connected to the handle and a processing unit connected with the display member, the strain transducer electrically connected with the processing unit, a length of the first recess being longer than a length of the second recess, and a hole defined through the handle and located between the first and second recesses, an axis of the hole being perpendicular to a direction of rotation of the function head.

2. The hand tool as claimed in claim 1, wherein a length of the first recess is equal to a length of the second recess.

3. The hand tool as claimed in claim 1, wherein the first and second recesses and the hole are located close to the function head.

* * * * *